US006594840B2

(12) United States Patent
Tomas et al.

(10) Patent No.: US 6,594,840 B2
(45) Date of Patent: Jul. 22, 2003

(54) BABY BOUNCER/BASSINET

(75) Inventors: Jorge Tomas, Wrentham, MA (US); Allan Ferraro, Attleboro, MA (US); Brian C. Sundberg, Chester, NH (US)

(73) Assignee: Cosco Management, Inc., Wilmington, DE (US)

( * ) Notice: Subject to any disclaimer, the term of this patent is extended or adjusted under 35 U.S.C. 154(b) by 25 days.

(21) Appl. No.: 09/888,078

(22) Filed: Jun. 22, 2001

(65) Prior Publication Data

US 2002/0002741 A1 Jan. 10, 2002

Related U.S. Application Data

(60) Provisional application No. 60/214,611, filed on Jun. 28, 2000.

(51) Int. Cl.[7] ..... A47D 9/00

(52) U.S. Cl. ..... 5/655; 5/101; 5/102

(58) Field of Search ..... 5/655, 100, 102, 5/101, 657; 297/452.13, 440.11, 440.12

(56) References Cited

U.S. PATENT DOCUMENTS

| | | | |
|---|---|---|---|
| 243,573 | A | 6/1881 | Jones |
| 692,501 | A | 2/1902 | Bentley |
| 751,125 | A | 2/1904 | Wertz et al. |
| 778,330 | A | 12/1904 | Pond |
| 812,387 | A | 2/1906 | Wertz |
| 962,587 | A | 6/1910 | Raettig |
| 1,126,236 | A | 1/1915 | Lees |
| 1,240,499 | A | 9/1917 | Sisbower et al. |
| 1,403,552 | A | 1/1922 | Holmes |
| 1,412,935 | A | 4/1922 | Greenebaum |
| 1,463,500 | A | 7/1923 | Burroughs |
| 1,559,352 | A | 10/1925 | Nelson |
| 1,568,063 | A | 1/1926 | Fagen |
| 2,277,406 | A | 3/1942 | Mahr |
| 2,300,425 | A | 11/1942 | Kiesow |
| 2,309,318 | A | 1/1943 | Jago |

(List continued on next page.)

FOREIGN PATENT DOCUMENTS

| | | |
|---|---|---|
| AT | 141106 | 3/1935 |
| AU | 140514 | 7/1949 |
| CH | 270503 | 9/1950 |
| DE | 32 31 710 A1 | 8/1982 |
| EP | 0 442 298 A1 | 1/1991 |
| FR | 2 566 252 A1 | 12/1985 |
| GB | 836778 | 6/1960 |
| GB | 2 163 045 A | 2/1986 |

*Primary Examiner*—Heather Shackelford
*Assistant Examiner*—Fredrick Conley
(74) *Attorney, Agent, or Firm*—Barnes & Thornburg

(57) ABSTRACT

A bassinet and bouncer combination is provided. The frame of the bassinet and bouncer combination is readily foldable such that it is easily carried and stored. The bassinet and bouncer combination may include a seat positionable in at least two positions such that it may be used as a traditional bassinet (reclined position) or traditional bouncer (sitting-up position). A baby support has a base with a portion that is adapted to lie on the floor, and a pair of arms that extend from their first ends upwardly and rearwardly from the portion and on one side thereof when in a deployed configuration. A connector mechanism joins the first ends of the arms to the portion enabling the arms to pivot through an arc so as to lie substantially in a same plane as the portion and on the other side thereof. A collapsible frame for a baby receptacle is attached to the other ends of the arms when in a collapsed position lying in substantially a same plane as the arms. The collapsible frame is carried by the arms above the portion when in a deployed configuration and lies substantially in the plane of the portion when in a stored configuration.

24 Claims, 9 Drawing Sheets

U.S. PATENT DOCUMENTS 2,535,531 A 12/1950 Conrad
2,587,255 A 2/1952 Vogel et al.
2,601,885 A 7/1952 Irvine
2,636,190 A 4/1953 Avila
2,636,548 A 4/1953 Berlin
2,691,177 A 10/1954 Leonard
2,709,478 A 5/1955 Golding et al.
2,781,225 A 2/1957 Heideman
2,848,040 A 8/1958 Chernivsky
2,872,203 A 2/1959 Hedstrom
2,949,628 A 8/1960 Koltun
2,989,318 A 6/1961 Schenkman
3,004,793 A 10/1961 Loomis
3,019,052 A 1/1962 Zawadzki
3,049,727 A 8/1962 Ruddy
3,115,364 A 12/1963 Berlin
3,157,430 A 11/1964 Hamilton
3,235,306 A 2/1966 Chernivsky
3,279,846 A 10/1966 Morosini
3,311,934 A 4/1967 Goldberg
3,330,575 A 7/1967 Boudreau
4,072,318 A 2/1978 Laune
4,141,095 A 2/1979 Adachi
4,295,683 A 10/1981 Dubbink et al.
4,516,806 A 5/1985 McDonald et al.
4,553,786 A 11/1985 Lockett, III et al.
4,577,355 A 3/1986 Kassai
4,598,946 A 7/1986 Cone
4,603,904 A 8/1986 Tolleson et al.
4,615,560 A 10/1986 Schaller
4,618,184 A 10/1986 Harvey
4,634,177 A 1/1987 Meeker
4,656,680 A 4/1987 Wilson
4,660,237 A 4/1987 Brodnax
4,822,030 A 4/1989 Cone
4,836,573 A 6/1989 Gebhard
4,911,499 A 3/1990 Meeker
4,967,432 A 11/1990 Kujawski et al.
4,982,997 A 1/1991 Knoedler et al.
4,986,599 A 1/1991 Wise
4,998,307 A 3/1991 Cone
5,052,749 A 10/1991 Groenendijk
5,087,066 A 2/1992 Mong-Hsing
5,092,004 A 3/1992 Cone et al.
D325,132 S 4/1992 Cone
5,115,523 A 5/1992 Cone
5,172,955 A 12/1992 Freese et al.
5,187,826 A * 2/1993 Mariol ..... 297/295
5,203,611 A 4/1993 Greenwood
5,207,478 A 5/1993 Freese et al.
D337,894 S 8/1993 Mariol
5,269,587 A 12/1993 Cunningham et al.
5,269,591 A 12/1993 Miga, Jr. et al.
D343,958 S 2/1994 Greenwood
5,308,143 A 5/1994 Cheng et al.
5,342,113 A 8/1994 Wu
5,360,258 A 11/1994 Alivizatos
5,364,137 A 11/1994 Shimer
5,411,315 A * 5/1995 Greenwood ..... 297/440.11
5,441,328 A 8/1995 Snyder
5,460,430 A 10/1995 Miga, Jr. et al.
5,464,381 A 11/1995 Wilson
5,503,458 A 4/1996 Petrie
5,507,550 A 4/1996 Maloney
5,507,564 A * 4/1996 Huang ..... 297/256.13
5,509,721 A 4/1996 Huang
5,527,096 A 6/1996 Shimer
5,575,530 A 11/1996 Harper et al.
5,586,351 A 12/1996 Ive
5,590,896 A 1/1997 Eichhorn
5,617,594 A 4/1997 Chien
5,660,435 A 8/1997 Eichhorn
5,669,624 A 9/1997 Eichhorn
5,688,211 A 11/1997 Myers
5,694,655 A 12/1997 Shepler et al.
5,772,235 A 6/1998 Espenshade
5,819,341 A 10/1998 Simantob et al.
5,863,097 A 1/1999 Harper et al.
5,868,459 A 2/1999 Welsh, Jr.
5,887,945 A 3/1999 Sedlack
5,916,089 A 6/1999 Ive
5,934,757 A 8/1999 Smith
5,947,552 A 9/1999 Wilkins et al.
5,988,744 A 11/1999 Franchak
6,036,263 A 3/2000 Gold
D431,940 S 10/2000 Brown et al.
6,257,659 B1 7/2001 Wilkins et al.

* cited by examiner

BABY BOUNCER/BASSINET

The invention relates to furniture for infants, and more particularly to a seat for an infant that may be used as either a "bassinet" or a "bouncer".

BACKGROUND OF THE INVENTION

There are a number of different devices used for child care to support a child when they are reclining or sitting, such as bassinets and bouncers. Bassinets or cradles are well known and are generally used to provide a secure place for sleeping infants. Bassinets may take on numerous different configurations. Bassinets are typically small and are used to keep the infant close to the parents while the infant is sleeping. Typically, bassinets are elevated above the ground and include a frame to form a flat horizontal space enclosed with sidewalls. The flat space is large enough to accommodate an infant when the infant is lying down for sleeping. Bassinets also generally may include a canopy to shade the infant from excess light. Some bassinets may be capable of being rocked by hand, and others may be provided with a mechanism to automatically rock the bassinet.

Bouncer seats are also well known and are generally used to comfortably support and rock infants in a seated position. Bouncers have also been provided in numerous different configurations. Generally, bouncers include a wire frame having a base frame adapted to be supported on a flat surface, and an angled portion upwardly and rearwardly extending from the base frame and adapted to support leg and back portions of a seat. Typically, the seat is covered with a fabric and will comfortably support an infant. The angled portion is resiliently deflectable downwardly toward the base frame of the wire frame thereof. Thus, when an infant sits in the fabric covered seat, the infant may be gently rocked in a slight up and down motion when the back and leg portions are moved up and down by a supervising adult or by the infant's own movements. Bouncers also frequently are provided with a vibrator to additionally provide a soothing vibration for the infant, either during play-time or naptime. An activity toy bar and multiple position canopies to shade the infant from strong light are also generally provided with bouncers.

Generally, it is desirable to have bassinets and bouncers that are readily foldable for transport or storage. Moreover, usually one device that may function as both a bassinet and bouncer is desirable as use of different devices creates additional cost and a need for more storage space at home and during travel with the infant. Thus, a readily foldable device which serves more than one purpose is desirable.

SUMMARY OF THE INVENTION

Generally, a bassinet and bouncer combination is provided. The frame of the bassinet and bouncer combination is readily foldable such that it is easily carried and stored. The bassinet and bouncer combination includes a seat positionable in at least two positions such that it can be used as a traditional bassinet (reclined position) or a traditional bouncer (sitting up position). Moreover, the device is collapsible such that it includes a deployed and a stored configuration.

In one illustrative embodiment of the invention, a baby bouncer/bassinet combination is provided. The baby bouncer/bassinet combination comprises a base having a U-shaped segment that is adapted to lie on the floor and arms connected, one to each end of the U-shaped segment and extending upwardly and rearwardly therefrom and on one side thereof, when the bouncer/bassinet is in a deployed configuration. A connector is attached to an upper end of each arm. First and second U-shaped supports are attached to the connectors for carrying a cradle-like bed and are pivotally movable with respect to one another between a deployed position where they are apart from one another, and a collapsed position where they are closely adjacent one another, as a continuation of and in substantially a same plane as the arms. Folding mechanisms are provided in the base joining each of the arms to the ends of the U-shaped base segment and enabling the arms to pivot on the ends of the U-shaped segment in a forward direction through approximately at least 270° so that the arms and the first and second U-shaped supports lie substantially parallel to and on the other side of the U-shaped base segment.

According to another aspect of the invention, the bouncer/bassinet combination is provided with one of the U-shaped supports fixed with respect to the arms in substantially the same plane as the arms. The bouncer/bassinet combination may be provided with a U-shaped canopy frame member disposed adjacent one of the U-shaped supports. In a stored position, the U-shaped canopy frame member may lie essentially parallel to the U-shaped support and in an active position is joined to the connector and diverges from the connector away from that U-shaped support. The bouncer/bassinet combination may be provided with a vibrator mounted in one of the folding mechanisms. The bouncer/bassinet combination may be provided with each of the connectors including a pair of substantially parallel sockets that receive the ends of the arms and the ends of one of the U-shaped supports. According to another aspect of the invention, the bouncer/bassinet combination is provided with the sockets substantially coaxial. Additionally, the ends of the other of the U-shaped supports may be pivotally attached to the connectors. The bouncer/bassinet combination may include a socket provided in each of the connectors substantially perpendicular to the other sockets. Moreover, the canopy frame may be detachably joined to the connector by a post mounted on the connector and a slot receiving the post on each end of the canopy frame.

In another illustrative embodiment of the invention, a baby support is provided. The baby support comprises a base having a U-shaped floor engaging portion and pair of arms that extend upwardly and rearwardly from the U-shaped portion, and on one side thereof when in a deployed configuration. A connector mechanism joins the arms to the ends of the U-shaped portion enabling the arms to pivot on the connector mechanism through an arc of more than 270°, and in the illustrated embodiment approximately 315° so as to lie substantially in a same plane as the U-shaped portion and on the other side thereof. A collapsible frame for a baby receptacle is attached to the other ends of the arms. When collapsed, the collapsible frame lies in substantially the same plane as the arms. The collapsible frame is carried by the arms above the floor when in the deployed configuration and lies substantially in the plane of the U-shaped portion when in a stored configuration.

According to another aspect of the invention, the baby support is provided with a cradle-like baby support suspended from U-shaped supports of the collapsible frame. The baby support may have a foldable bottom wall enabling the baby support to collapse to a flat configuration when the U-shaped supports are in the collapsed position. The baby support may be provided with a cradle-like baby support connected to the U-shaped supports. A pair of canopies may be connected to the baby support adjacent the first and second U-shaped supports and movable between elevated and collapsed positions. A closure connecting the canopies together when in the elevated position to enclose a top of the baby support is also provided. The baby support may be provided with fasteners attached to one end of the baby support for selectively elevating the bottom wall at that end for positioning a baby within the baby support into a substantially sitting position, In another illustrative embodiment of the invention, a baby support is provided. The baby support comprises a base having a portion adapted to lie on the floor and pair of arms that extend from their first ends upwardly and rearwardly from the portion and on one side thereof when in a deployed configuration. A connector mechanism is provided joining the first ends of the arms to the portion, and enabling the arms to pivot through an arc so as to lie substantially in a same plane as the portion and on the other side thereof. A collapsible frame for a baby receptacle is attached to the other ends of the arms, and when collapsed lying in substantially the same plane as the arms. The collapsible frame is carried by the arms above the portion when in the deployed configuration, and lies substantially in the plane of the portion when in a stored configuration.

According to another aspect of the invention, the collapsible frame of the baby support includes U-shaped supports that support a baby receptacle. The baby receptacle may have a foldable bottom wall that enables the baby receptacle to collapse to a flat configuration when the U-shaped supports are in the collapsed position. One of the U-shaped supports of the collapsible frame may be fixed with respect to the arms in substantially the same plane as the arms. The baby support may be provided with a fastener attached to one end of the baby receptacle for selectively elevating the bottom wall at that end for positioning the baby receptacle into a substantially sitting position. One of the U-shaped supports may define the head end of receptacle and the other U-shaped support may define the foot end of the receptacle and is at an acute angle to the arm. The receptacle may have a bottom wall with the height of the side wall increasing from the front end to the head end thereof. The arms of the baby support may be pivotable through an arc exceeding 270°, and as shown approximately 315°.

In another illustrative embodiment of the invention, a baby support is provided. The baby support comprises a base having a floor engaging portion and a pair of arms connected at first ends to and extending upwardly and rearwardly from the portion to one side thereof when in a deployed configuration. A folding mechanism joins the arms to the ends of the floor engaging portion, and enables the arms to pivot around their first ends on the folding mechanism through an arc of more than 270°, and as shown in the illustrated embodiment, through approximately 315° so as to lie substantially in a same plane as the floor engaging portion and on the other side thereof. A collapsible frame for supporting a baby receptacle is attached to the other ends of the arms, and when collapsed lies in substantially the same plane as the arms. The baby receptacle is carried by the arms above the floor when in the deployed configuration and lies substantially in the plane of the floor engaging section when in a stored configuration.

According to another aspect of the invention, the baby support is provided with the folding mechanism including a lock for releasably holding the arms in the deployed position. The baby support may be provided with a lock adapted to hold the arms in the collapsed position on the other side of the floor engaging portion.

In another illustrative embodiment of the invention, a baby support is provided. The baby support comprises a base having a portion adapted to lie on the floor and pair of arms that extend from their first ends upwardly and rearwardly from the portion and on one side thereof when in a deployed configuration. A connector mechanism is provided joining the first ends of the arms to the portion, enabling the arms to pivot rearwardly and downwardly through an arc so as to lie substantially in a same plane as the portion and on the other side thereof. A collapsible frame for a baby receptacle is attached to the other ends of the arms, and when in a collapsed position lying in substantially the same plane as the arms. The collapsible frame is carried by the arms above the portion when in the deployed configuration, and lies substantially in the plane of the portion when in a stored configuration.

According to another aspect of the invention, the arms extend substantially parallel to and in the same direction from the connectors as the portion in a collapsed position.

BRIEF DESCRIPTION OF THE DRAWINGS

Other features and advantages of the invention will become apparent from the following detailed description taken in conjunction with the accompanying drawings, in which.

DETAILED DESCRIPTION

Figure 1:
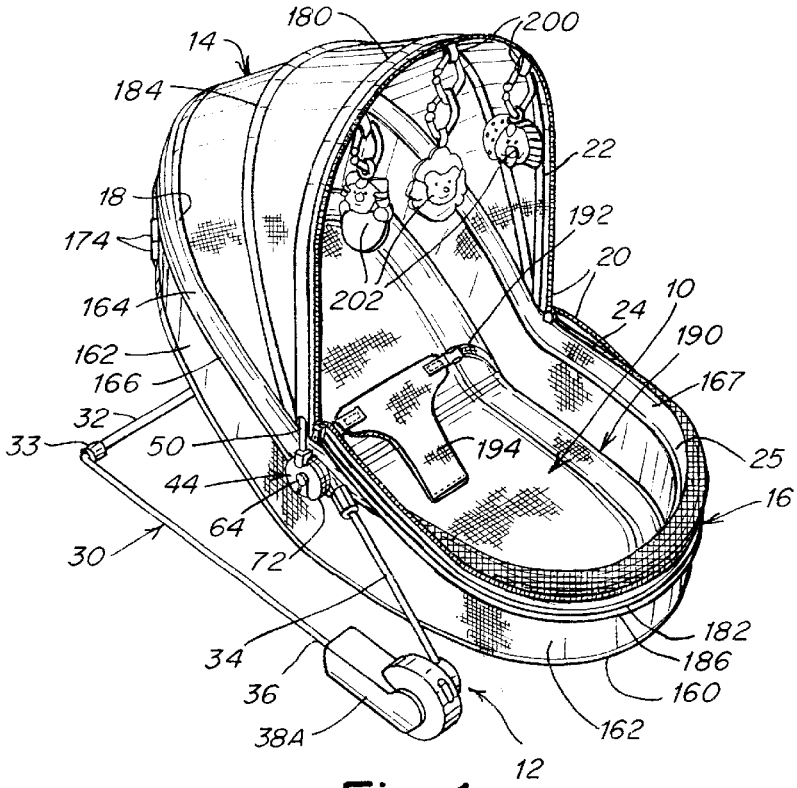
FIG. 1 is a perspective view of the bouncer/bassinet embodying the present invention shown in its operative or deployed position and with the head canopy open.

The bassinet/bouncer combination shown in FIG. 1 includes a baby support 10 carried by a frame 12. The baby support 10 may include canopies 14 and 16 at the head and foot ends, respectively. The canopy 14 at the head end may be elevated to the raised position shown in FIG. 1 or it may be collapsed so that its frame lies essentially in the plane of the top edge 18 of the baby support when not in use. As shown, the canopy 16 at the foot end of the support may be held in the raised position by moving the canopy 16 at the foot end of the support. Also, the canopy 16 may be held in the raised position by closing the zipper 20 attached to the free edges 22 and 24 of the canopies 14 and 16 when it is desired to completely enclose the baby in the support 10. If the zipper is not closed, the canopy 16 at the foot end may be moved to the open position of FIG. 1 wherein it lies adjacent the top edge 25 of the baby support. Any other suitable closure mechanisms may be used for zipper 20, such as buttons, snaps or Velcro-type hook and loop fasteners.

Figure 2:
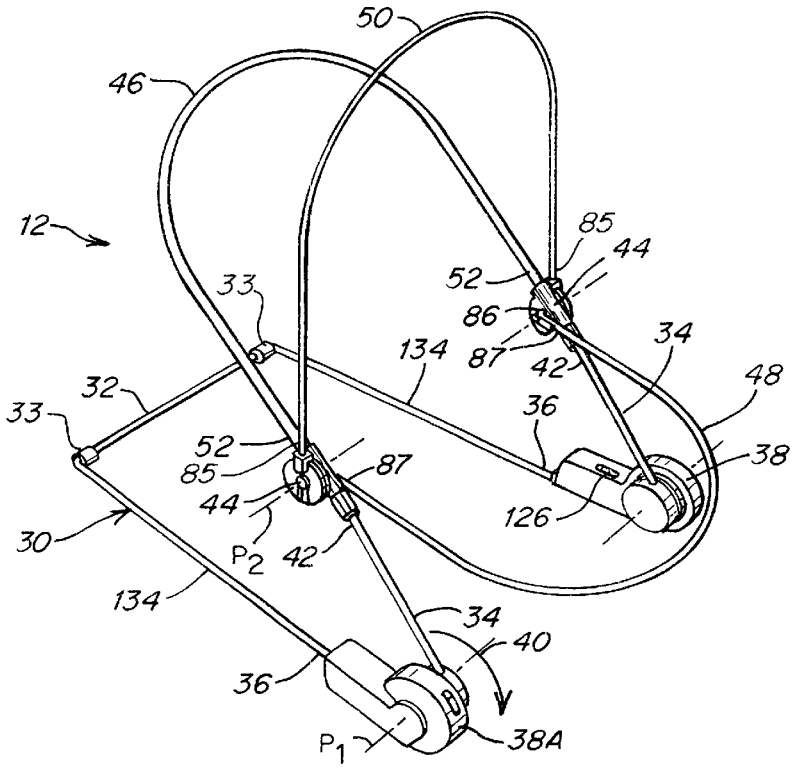
FIG. 2 is a perspective view of the frame of the bassinet/bouncer in its deployed position, and with all of the fabric removed so as to expose the various components of the frame.
Figure 3:
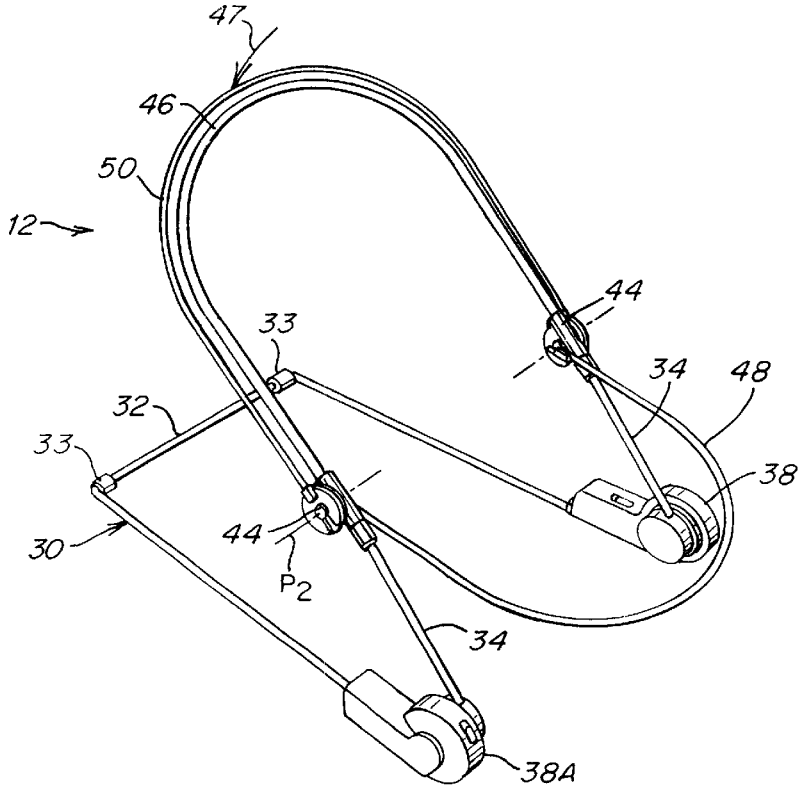
FIG. 3 is a perspective view of the frame, but with the wire that supports the head canopy in the collapsed or retracted position.
Figure 6:
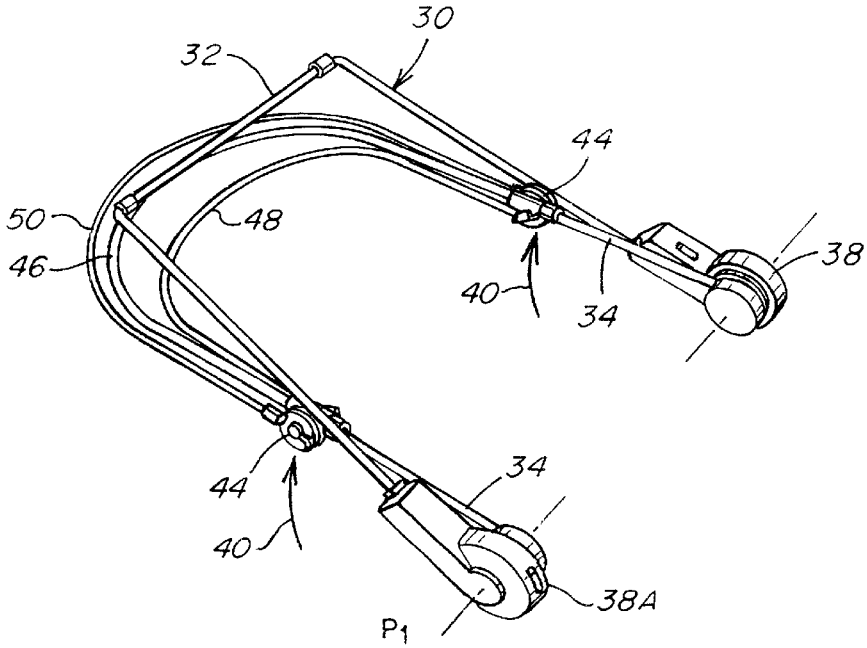
FIG. 6 is a perspective view of the frame showing the frame in its fully collapsed configuration.

The frame 12 is shown in FIGS. 2 and 3 disposed in the erect or deployed position and includes a base section 30 having a U-shaped portion 32 that lies flat on the floor and upwardly and rearwardly extending arms 34. The frame preferably is made of lightweight rigid material such as metal tubing, but may be made of any other suitable material, such as plastic. The tubing may be solid or hollow. Sleeves 33 and pads 150 (see FIGS. 9–11) act as feet for the frame and may assist in keeping the bassinet/bouncer from sliding on certain types of flooring such as wood, vinyl or tile flooring. The sleeves 33 and pads 150 are preferably made of rubber. Base section 30 may be made of multiple pieces of tubing connected to each other using sleeves 33 with a friction fit. Additionally, pads 150 may provide a friction fit between the base section 30 and folding mechanisms 38 and 38A. The arms 34 are connected to the front ends 36 of the U-shaped portion 32 at the folding mechanisms 38 as is described more fully below. The folding mechanisms 38 allow the arms 34 to move through an arc, preferably of at least about 270°, and as illustrated approximately 315°, in a clockwise direction about pivot point $P_1$ from the position shown in FIG. 2 and suggested by arrow 40 to a position in substantially a same plane as the U-shaped portion 32 of the base and beneath it as suggested in FIG. 6.

The upper ends 42 of the arms 34 are attached to pivoting connectors 44 that in turn support the U-shaped wire segments 46 and 48 of the frame that together carry the head and foot ends, respectively, of baby support 10. A third U-shaped wire segment or canopy wire 50 connected to the front edge of the canopy 14 is also selectively attached to the connectors 44 when the canopy 14 is opened.

Figure 4:
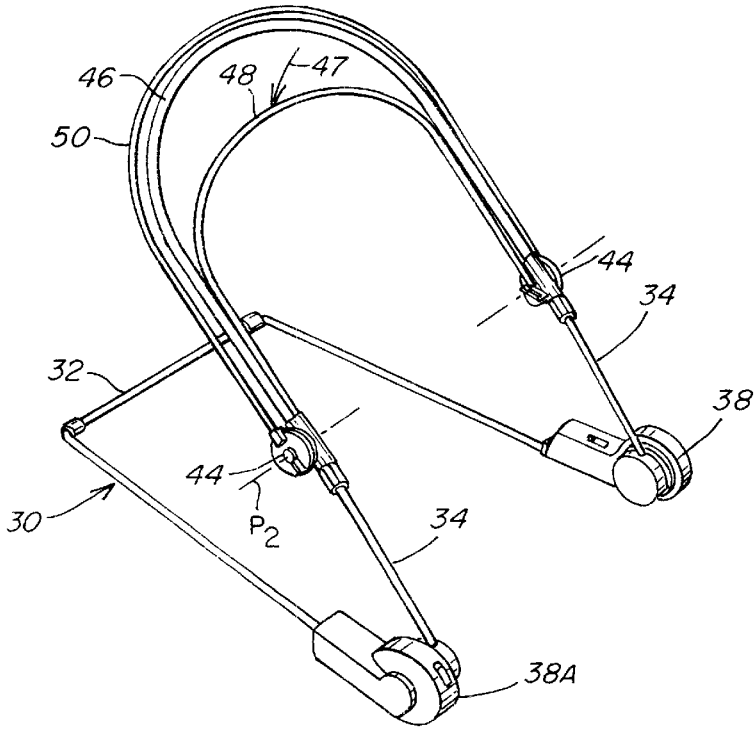
FIG. 4 is a perspective view of the frame with the wire that supports the leg end of the frame in the retracted position.
Figure 5:
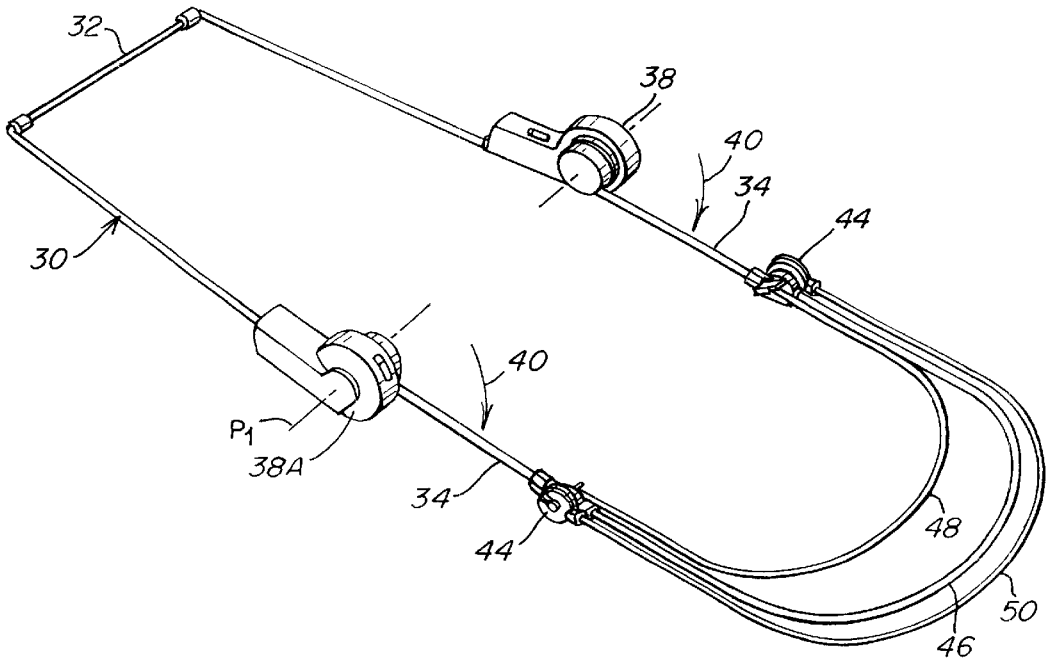
FIG. 5 is a further perspective view of the frame, but showing it in its intermediate position, that is, between its fully deployed and fully collapsed positions.

In the erect or deployed position of the frame shown in FIG. 2, the arms 34 are essentially aligned with the arms 52 of the U-shaped wire segment 46 of the frame and that relationship does not change when the frame, with or without the baby support 10, moves between its deployed and fully collapsed positions. On the other hand, the U-shaped wire segment 48 joined to the connectors 44 moves from the deployed position of FIGS. 2 and 3 to the retracted position of FIG. 4 wherein it is disposed essentially in the plane of the wire segment 46 by pivoting about pivot point $P_2$ as suggested by arrow 47. The configuration and details of the connectors 44 are described in detail below.

Figure 7:
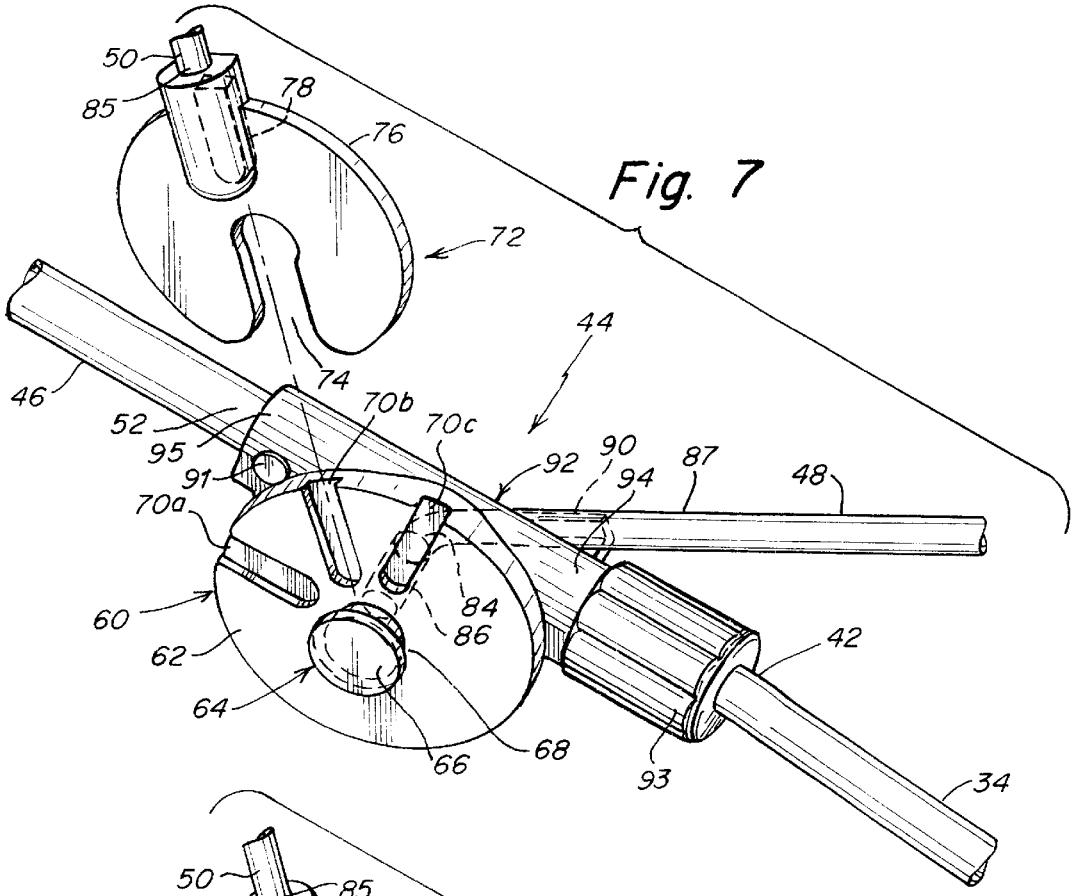
FIGS. 7 and 8 are perspective views of the two connectors that join the several U-shaped wires of the frame and the arms of the base.
Figure 8:
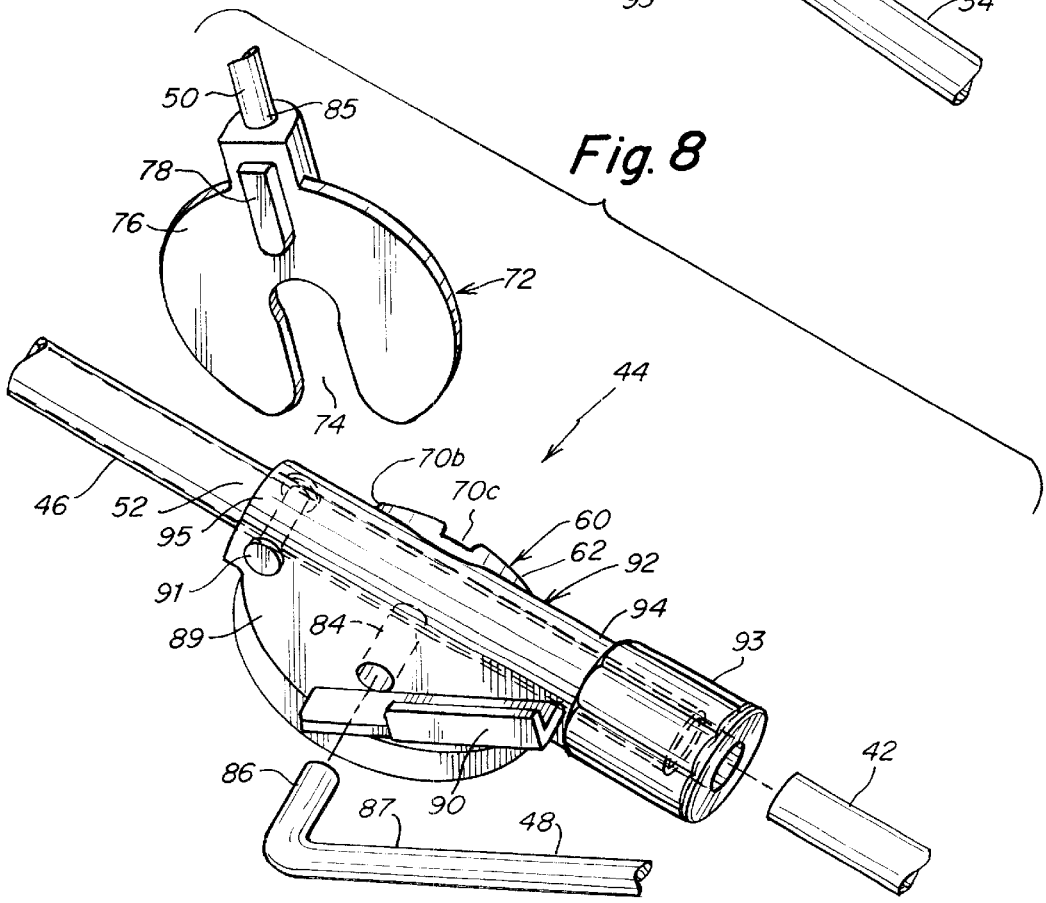

In FIGS. 7 and 8, the details of one embodiment of the connectors according to the invention are shown, although any type of connector may be used. The two connectors are mirror images of one another and perform in the same manner. The 10 connector includes a flat disk 60 on the outer surface 62 of which is a post 64 having an enlarged head 66 that defines a slot 68 between the head 66 and the outer surface 62. The surface 62 of the disk 60 also carries three generally radial slots or grooves 70*a*–70*c* that cooperate with the post 64 to releasably hold the C-shaped clip 72 on each end 85 of the canopy wire 50 of canopy 14. The clip 72 includes a slot 74 sized to slip onto the post 64 and more particularly into the slot 68 about the post 64 and beneath the post head 66. The C-shaped clip 72 also has on its face 76, facing the surface 62 of the disk 60, a rib 78 sized to fit within any of the grooves 70*a*–70*c*. The user may select any of the grooves 70*a*–70*c* to determine the angular position of the canopy wire 50 with respect to the upper edge 18 of the baby support, that is, to determine how much the canopy is open. It is evident that if the rib 78 is inserted in the groove 70*c*, the canopy will be opened the maximum extent. If the rib 78 is placed in groove 70*b*, the canopy will be opened a significantly smaller amount, and if the rib 78 is placed in groove 70*a* the canopy will be even more collapsed. If the canopy 14 is to be fully collapsed, the C-shaped clip 72 may be removed from the slot 68 and canopy wire 50 lies flat on the edge 18 of the baby support.

The connector 44 also includes a sleeve 92 open at both ends so as to receive at its lower end 94 the upper end 42 of arm 34 and at its upper end 95 to receive the end of the arm 52 of U-shaped wire segment 46. As the sleeve 92 is essentially straight, the arm 52 of the U-shaped wire segment 46 and the arm 34 of the base are maintained in alignment with one another. The ends of the arms 34 and 52 telescopically fit into the sleeve 92 and arm 34 may telescopically fit within wire segment 46. Preferably, the U-shaped wire segment 46 is permanently fixed to the two connectors 44, for example as shown rivet 91 may permanently fix the wire segment 46 in the sleeve 92. Rivet 91 may also act as a stop to prevent upper end 42 of arm 34 from telescoping further into sleeve 92 and wire segment 46. Preferably, the arms 34 of the base are removably attached and assembled by the ultimate purchaser. For example, rubber sleeves 93 may be used to connect the arm 34 to the connector 44 by a friction fit. Once assembled, however, ordinarily there is no need to detach the connectors 44 from the arms 34 as the assembled bouncer/bassinet may be collapsed into a compact unit for transport or storage.

On the side 89 of the sleeve 92 opposite the disk 60 an opening 84 perpendicular to the plane of the disk is provided that receives end 86 of the U-shaped wire segment 48 that supports the foot end of the baby support 10. The ends 86 of the U-shaped wire 48 are perpendicular to the sides 87 of the U-shaped wire segment. The wire segment 48 is free to rotate about the pivot point $P_2$ at the axis of its end 86 between the substantially horizontal position as shown in FIGS. 2 and 3 and the position shown in FIG. 4 wherein it lies essentially in the plane of the U-shaped segment 46. A stop 90 extends outwardly from the side 89 and provides a support for the U-shaped segment 48 when in the open or horizontal position of FIGS. 2 and 3. Thus, the stop 90 prevents the U-shaped segment 48 from tipping downwardly below the approximately horizontal position. It will be understood that other arrangements may be used as known to one of ordinary skill in the art.

Figure 9:
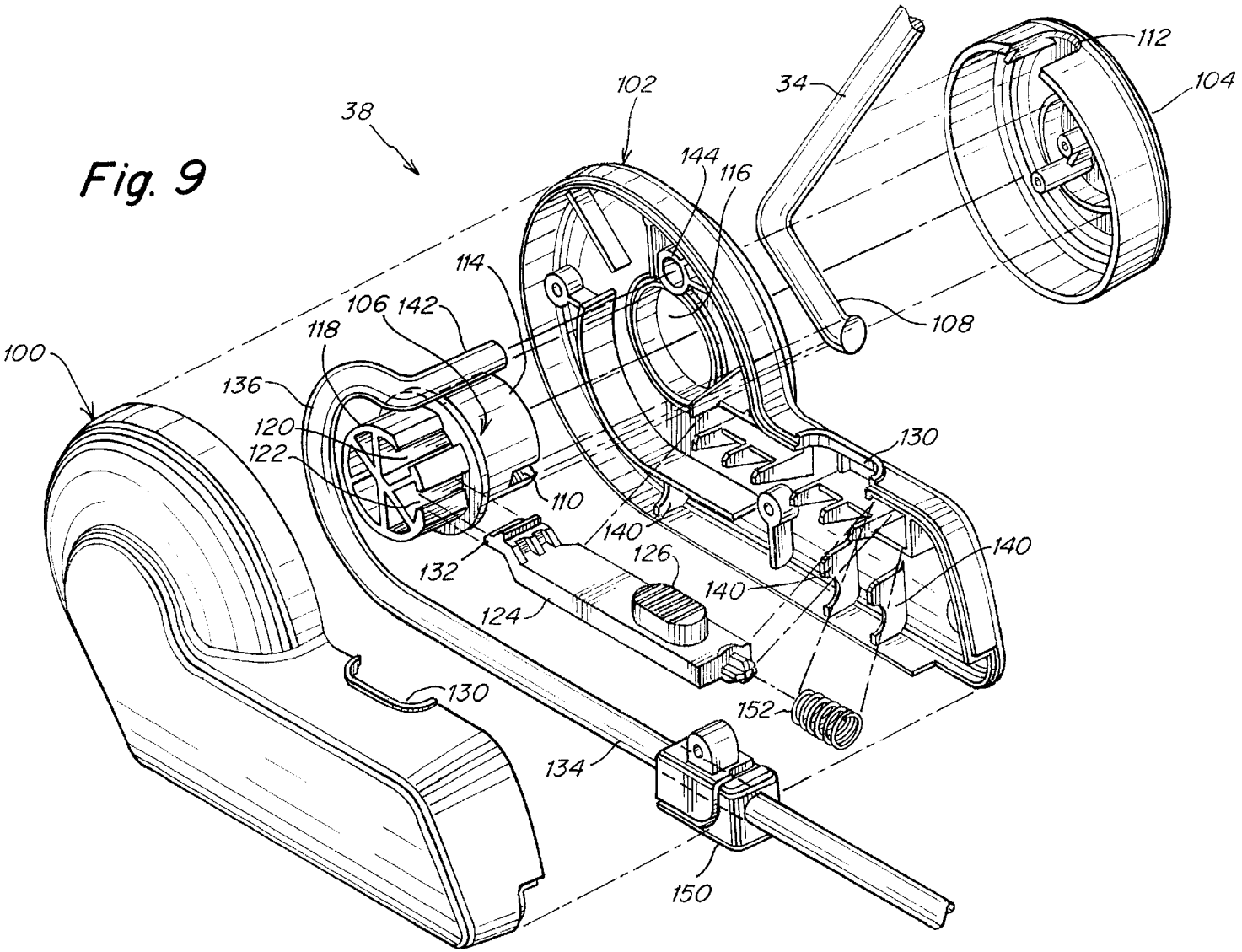
FIG. 9 is an exploded perspective view of the folding mechanism that forms part of the base of the bouncer/bassinet shown in FIG. 1.
Figure 10:
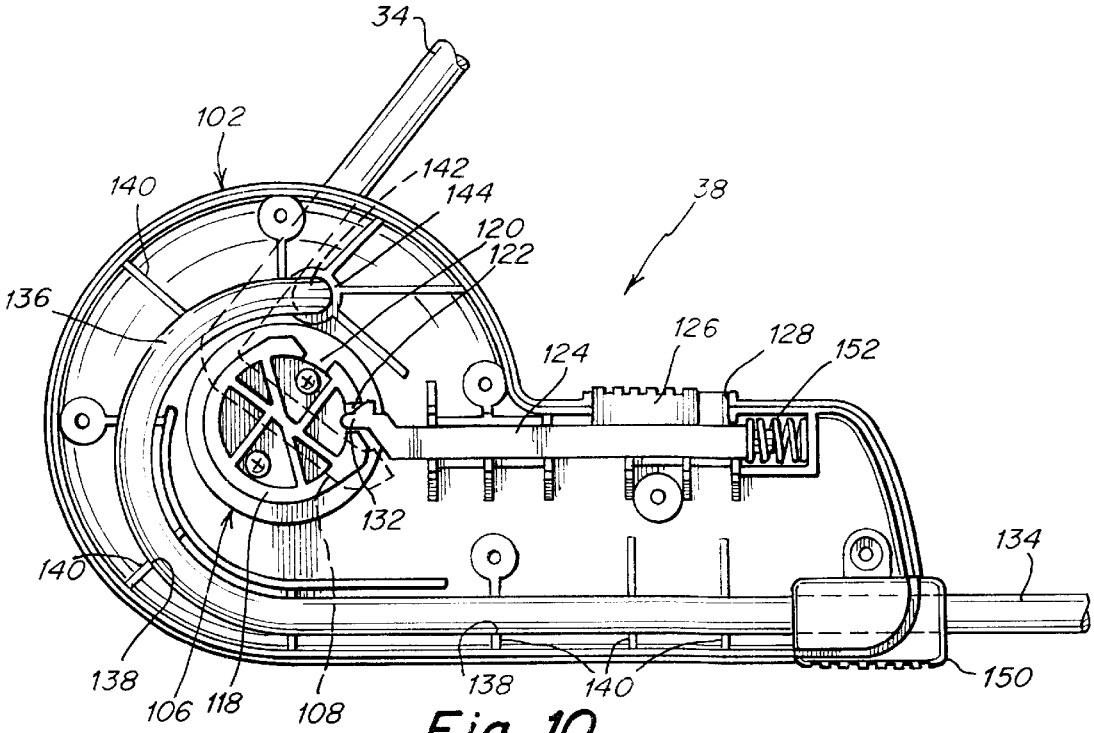
FIG. 10 is a side view of the mechanism of FIG. 9 with half the housing removed to show the manner in which the base wires are joined together and how it allows the base and frame to move between the deployed and collapsed positions.
Figure 11:
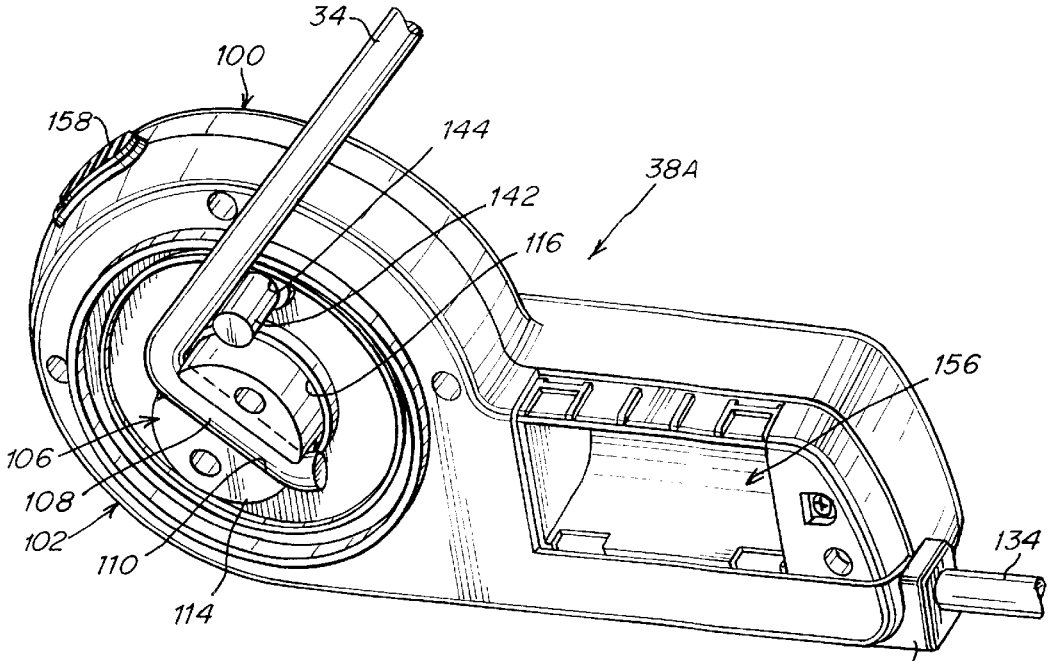
FIG. 11 is a perspective view of the mechanism on the side opposite that shown in FIG. 10 and with the cap removed to show how a portion of the base is connected to it.

One of the folding mechanisms 38 according to one aspect of the invention is shown in detail in FIGS. 9–11, although other folding mechanisms may be used. The exploded view of FIG. 9 shows the mechanism to include outer housing 100 and inner housing 102 that when closed, mate with one another about their peripheries. An inner pivot cap 104 is rotatably mounted on the inner side of housing segment 102. The arm 34 forming part of base section 30 has a hook 108 that is disposed in a slot 110 on the inner side of a disk 106 in the housing. The portion of the arm 34 adjacent hook 108 extends out of the housing through slot 112 in the cap 104. As the cap 104 and disk 106 are rigidly connected together (by screws or any other suitable connectors), the arm 34 moves rotatably about the axis of the disk 106 along with the cap. It is apparent from an inspection of the drawings that the end 114 of the disk 106 that engages the hook 108 of the arm 34 extends outwardly through the opening 116 in housing section 102. (See FIGS. 9 and 11). The other end 118 of the disk 106 is disposed within the housing between the two housing sections 100 and 102. The end 118 of the disk 106 has a pair of generally radial slots 120 and 122 that are selectively engaged by slide lock 124, also mounted within the housing between the housing sections 100 and 102. The slide lock carries a finger actuator 126 that extends out of the housing through an opening 128 formed by the recesses 130 in the peripheral walls of the housing sections 100 and 102. The slide lock 124 carries a finger 132 that moves in and out of one or the other of the two slots 120 and 122 in the disk 106.

The front ends of the arms 134 of base section 30 extend into the rear end of the folding mechanisms 38 as shown in FIGS. 9 and 10 and have a C-shaped configuration as shown at 136 so as to lie in a track 138 established by ribs 140 in the housing. The C-shaped end of each arm 134 includes an extension 142 perpendicular to the plane of the C-shaped end, that engages the cavity in boss 144 formed on the inside face of housing section 102. As is evident in FIG. 11, the extension 142 extends into the cap 104 and bears against and provides direct support to the arm 34. Preferably, the extension 142 and arm 34 are made of metal. The metal-to-metal contact and support for the bending action of the arm when the structure is employed as a bouncer takes substantial stress off the plastic parts of the mechanism.

In FIG. 10 the lock 124 and more particularly its finger 132 is shown engaging the slot 122 so as to maintain the disk 106 in a position to support the arm 34 in its operative or deployed position. When the finger 132 is withdrawn from the slot 122, the disk 106 and cap 104 along with the arm 34 are free to turn in a counter clockwise direction as viewed in FIGS. 10 and 11 so that both arms 34 may turn, for example through at least about 270°, and as shown approximately 315°, until they lie essentially in the plane of the base section 30. (See FIG. 6).

Figure 6A:
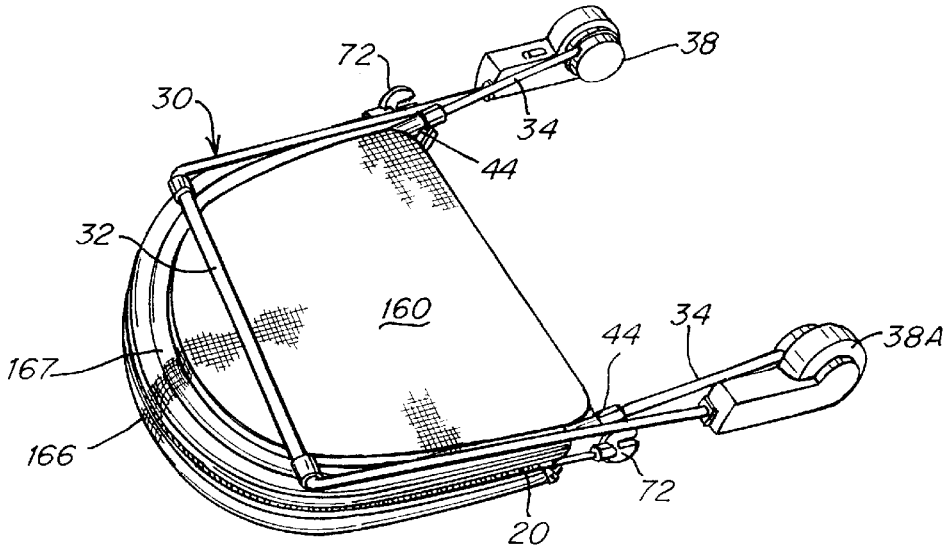
FIG. 6A is a perspective view of the bouncer/bassinet in the collapsed position corresponding to the position of the frame in FIG. 6.

It will be noted in FIGS. 9 and 10 that the folding mechanisms 38 include a rubber pad 150 at the rear end of the housing. A spring 152 is provided in the housing and bears against the lock 124 so as to urge the finger 132 into engagement with either of the slots 120 and 122 with which it is aligned. It should be appreciated that when the arm 34 completes its travel through at least 270° to the collapsed position of FIGS. 6 and 6A, the lock 124 and more particularly its finger 132 may engage the slot 120 so as to hold the bouncer/bassinet in the fully collapsed condition so that it is easy to transport or store.

While each of the folding mechanisms 38 have similar mountings for the side arms 134 and arms 34 of the frame, only one of the connectors need include the slide lock 124 for locking the arms 34 in the operative position. For example, while the folding mechanism 38 of FIG. 9 may include the slide lock 124 and its related parts, the mechanism 38A shown in FIG. 11 does not, but rather may have a cavity 156 that receives a battery. A vibrator (not shown) that are well-known in the art is located within the housing. The vibrator may, for example, include a motor, a weight, battery contacts and wiring. By placing the vibrator in one of the folding mechanisms 38, the vibration may be efficiently distributed through the bouncer/bassinet. Additionally, as discussed previously, resistance to sliding by the base section 30 may be achieved by use of rubber pads 150 and sleeves 33 provided on the base section. Preferably they are provided on U-shaped portion 32, that lies on the floor. The rubber sleeves and pads may assist the unit in resisting sliding and from moving when the vibrator is in use. Preferably the two rubber sleeves are provided over the tubing forming the U-shaped portion 32 and remain in contact with the ground when the unit is in use. A switch 158 is shown on the housing for turning the vibrator on and off. Preferably, the vibrator has both high and low speeds.

Figure 1A:
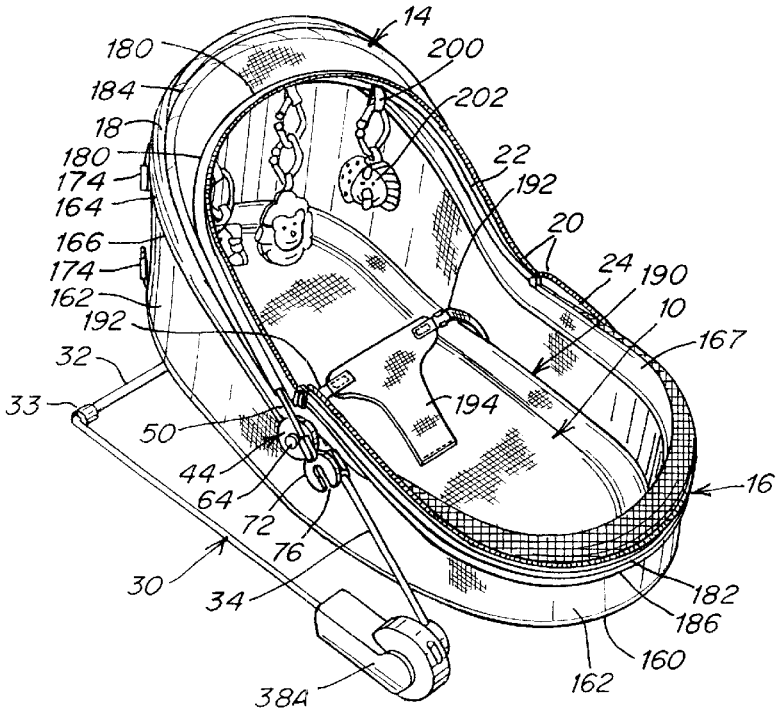
FIG. 1A is a perspective view of the bouncer/bassinet similar to FIG. 1 but with the head canopy collapsed and the baby support in the bassinet configuration.
Figure 1B:
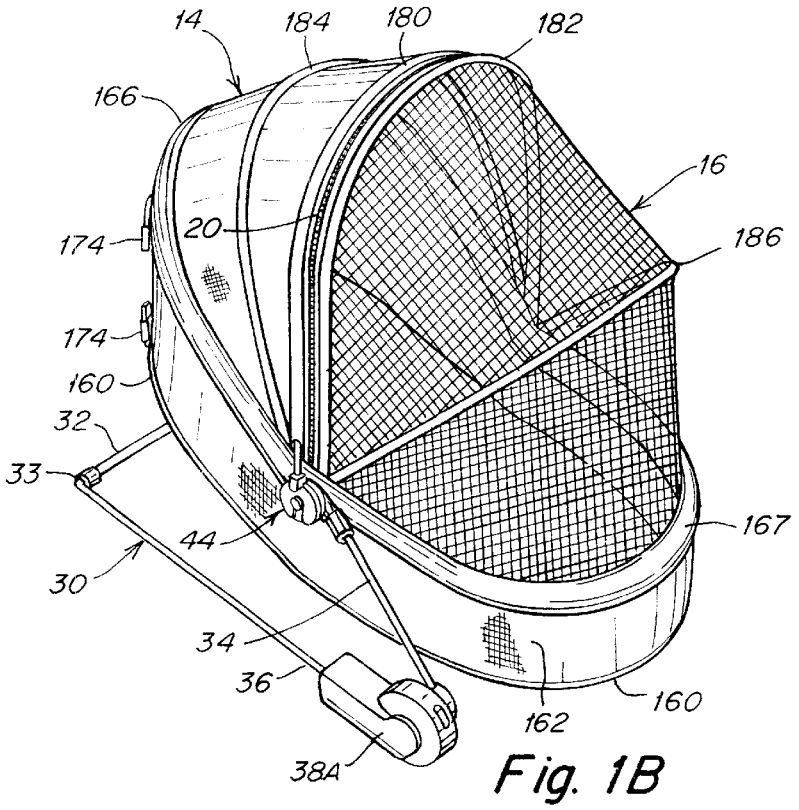
FIG. 1B is a perspective view similar to FIGS. 1 and 1A but with both the head and foot canopies raised to completely enclose the baby support.
Figure 1C:
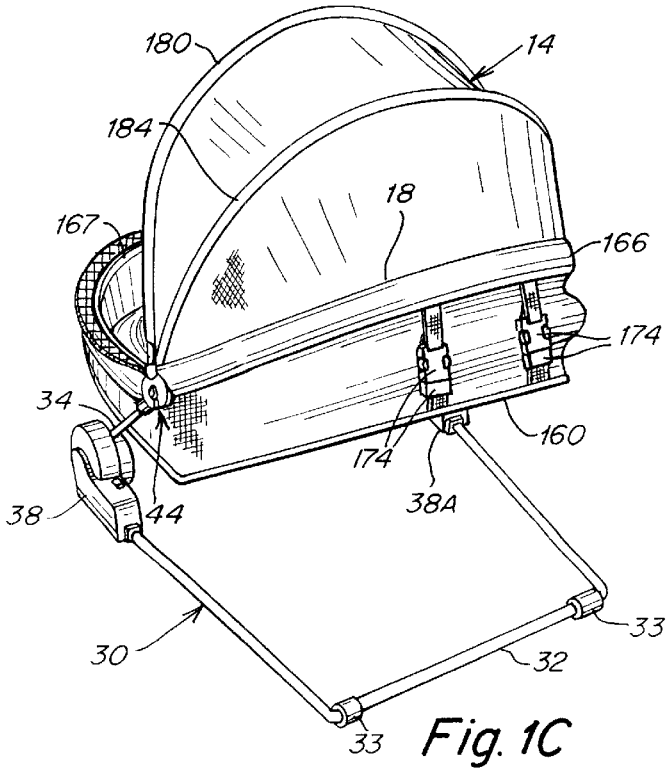
FIG. 1C is a rear perspective view of the bouncer/bassinet shown in FIG. 1.
Figure 1D:
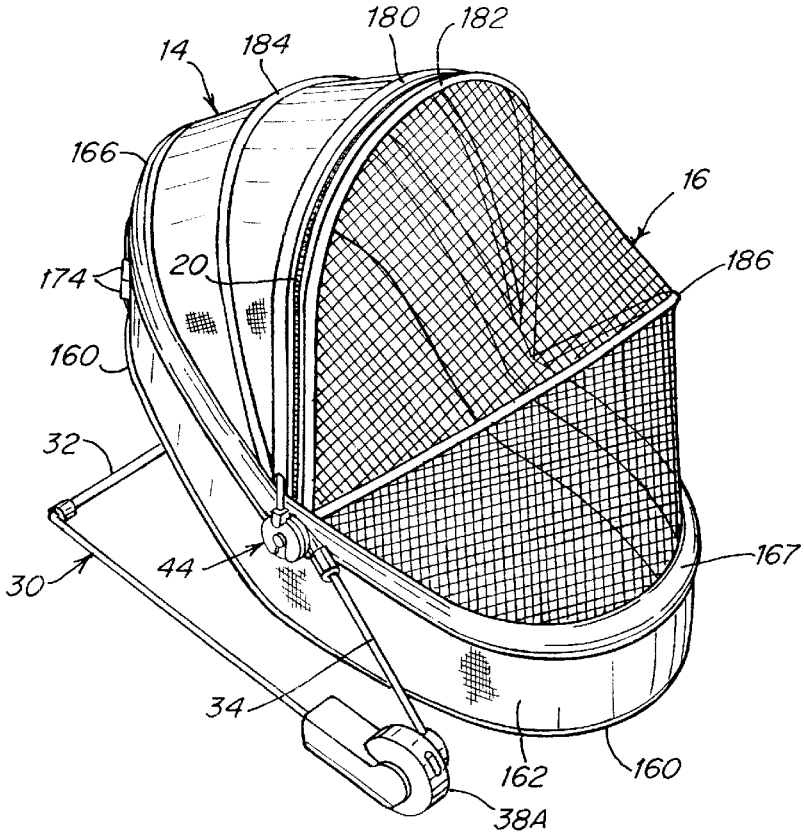
FIG. 1D is a view similar to FIG. 1B but with the baby support in the bouncer configuration.
Figure 12:
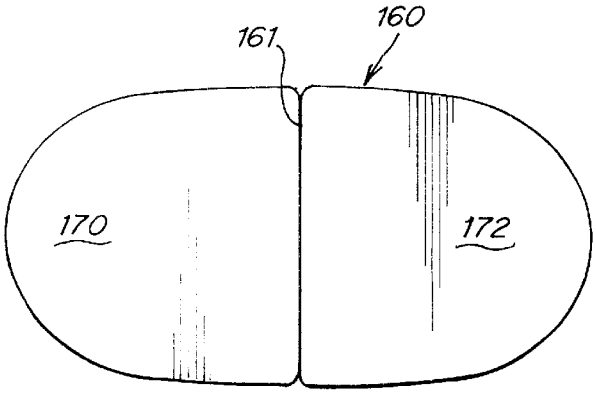
FIG. 12 is a plan view of the pair of stiffeners employed in the bottom wall of the baby support.

The fabric baby support 10, as shown in FIGS. 1–1D suspended from the U-shaped wires 46 and 48, includes a bottom wall 160, side walls 162, and a rim structure 164 about its top edge 18. Padded sleeves 166 and 167 may be provided about the rim structure and receive the U-shaped wire segments 46 and 48 of the frame so as to carry the baby support 10 on those wires. The bottom wall 160 of the baby support preferably includes a pair of stiff panels as suggested in FIG. 12, made of plywood, pressboard, or any other suitable material that possesses enough stiffness to prevent the bottom wall from sagging under the weight of a baby placed in the cradle-like support. As explained in greater detail below, the two panels 170 and 172 that are disposed respectively at the foot and head ends of the bottom wall enable the angular relationship between the two to be varied. That is, the bottom wall 160 can be folded along a line 161 defined by the adjacent edges of the panels. When the two lie substantially coplanar with one another, the baby support 10 is in the bassinet configuration and when the unit is to be used as a bouncer, the head portion 170 of the bottom wall is tilted upwardly with respect to the panel 172. For that purpose, toggle clips 174 are attached to the rim portion or top edge 18 and the edge of the bottom wall 160 so as to effectively foreshorten the height of the side wall 162 of the baby support 10 and elevate the head end of the baby as shown in FIGS. 1C and 1D.

It will be noted in FIGS. 1A and 1B that the height of the side wall 162 is fairly uniform at the foot end from the end of the baby support 10 to the vicinity of the connector 44. From the region of the connector to the head end of the baby support, the side wall 162 increases so as to provide a substantially level bottom wall when the toggles are open. The U-shaped wire 46 carrying the head end in the operative or deployed position is upwardly inclined and the side wall 162 compensates for it. When the toggle clips 174 are closed, a very substantial angle is created to achieve the bouncer configuration. (See FIG. 1D).

It will be appreciated that while toggle clips 174 are shown to foreshorten the height of the side wall 162 at the head end to create the bouncer configuration, other expedients may be employed for the same purpose, such as snaps, buckles, zippers, Velcro-type hook and loop fasteners, ties, etc.

It will be noted in FIGS. 1–1B that canopies 14 and 16 at the head and foot end are attached at their bottoms to the top edge 18 of the baby support, and each canopy also has a wire that extends about the free or top edge thereof, disposed in sleeves 180 and 182. The canopy wire 50 of canopy 14 has been described above and is disposed in sleeve 180, but the top wire in the canopy 16 is not visible as it is contained in the sleeve 182. The canopy wire 50 in the canopy 14 at the head end, is connected to the C-shaped clips 72 that support the head canopy 14 in the open position. Each canopy is also provided with an additional wire (not shown) intermediate its bottom and top edge, disposed in sleeves 184 and 186, to further support the canopies when they are elevated. Obviously, a larger or smaller number of wires may be used in each canopy to vary the shape or accommodate canopies of different size. The ends of the intermediate wires in the embodiment shown are simply captured in their sleeves and they need not be connected to the connectors 44. The canopy fabric itself may maintain them in the proper position. It will also be noted in the drawings that the canopy 16 at the foot end of the baby support 10 is made of a transparent mesh-type material that will allow the circulation of air into the enclosed space, particularly when the canopies are elevated as in FIGS. 1B and 1D, and also permits observation of the baby in the baby support, although, any other suitable material may be used for either canopy 14 and 16.

A detachable pad 190 is preferably included in the baby support and lies above the stiff panels 170 and 172 to provide a comfortable surface for the baby placed on it. Removability of the pad also facilitates its washing.

Preferably, a restraining belt 192 is provided in the baby support with a crotch pad 194 sewn to the main pad 190 and with straps attached to the lower portion of the side wall 162 of the baby support 10 in the approximate location of the connectors 44. The crotch pad and belts will somewhat restrain the child in the support 10 and prevent him/her from sliding toward the foot end, particularly when the head end is elevated to the bouncer configuration.

As is explained above in connection with the illustrations of the frame in FIGS. 2–6, the device may be readily collapsed from its fully erect or deployed position shown in FIG. 1 by the following steps. First, the head and foot canopies should be lowered so that they lie in close proximity to the top edges 18 and 25 of the baby support 10 defined by the padded sleeves 166 and 167 that receive the U-shaped wire segments 46 and 48. (See FIG. 1A). When that is done, the wire 48 in sleeve 167 is pivoted counter clockwise as viewed in FIG. 1A until it lies essentially in the plane of the canopy wire 50 and U-shaped wire segment 46 in sleeves 166 and 180, respectively. When the wire segment 48 is moved to that position, the bottom panels 170 and 172 fold readily about fold line 161, and the bottom wall of the baby support is free to fall into the plane of the wires 46 and 48. Next, the finger actuator 126 is pulled rearwardly so as to free the finger 132 of the lock 124 from the slot 122 in the disk 106 of the folding mechanism. This allows the arms 34 and the entire baby support with its frame members and canopies that have been collapsed into substantially a single plane, to pivot forwardly, or clockwise, at least 270° about the mechanisms 38 so that the assembly lies immediately adjacent the other side of the base section 30 of the frame. That action will further collapse the baby support, canopies and wire frame members as they engage the U-shaped portion 32 of the base section 30 of the frame. (See FIG. 6A). When the bouncer/bassinet is fully collapsed in that fashion, the finger 132 of the lock 124 may engage the slot 120 in the disk of the mechanism so as to retain the assembly in the collapsed condition for ease of carrying and storage.

As is shown in FIG. 1, a number of loops 200 may be provided along the upper edge of the head canopy 14 at the canopy wire 50. The loops facilitate hanging toys, noise makers 202, etc. close to the baby to entertain it. The toys of course, may be a wide variety of different items as selected by the person attending the child. When the canopy 14 is to be lowered, the toys preferably are removed from the loop so as not to bang against the infant's head or otherwise disturb the infant disposed in the baby support.

Preferably, a cover (not shown) is incorporated into the upper edge of the baby support as a continuation of or as an addition to the padded sleeves 166 and 167 that receive the U-shaped wires 46 and 48. This cover may extend over and enclose the connectors 44 so as to prevent a child from touching them. Such covers may also enhance the appearance of the device.

From the foregoing description those skilled in the art will appreciate that numerous modifications may be made of this invention without departing from its spirit. For example, the folding mechanisms 38 and the connectors 44 may be modified in many ways within the scope of this invention. The slide lock arrangement to hold the baby support in the operative position and enable the frame to fold into substantially a single plane may take many different forms. The lock may be oriented perpendicular to rather than axially with respect to the housing, and the configuration of the parts may be altered. Similarly, the frame members may be joined together by connectors of other forms that enable the parts to be deployed and collapsed in much the same fashion as in the illustrated embodiment. Therefore, the breadth of the invention is not to be limited to the specific embodiments illustrated and/or described. Numerous modifications will occur to those skilled in the art, and therefore, the scope of the invention is to be determined by the appended claims and their equivalents.

What is claimed is:

1. A baby support comprising:

a base having a U-shaped segment that is adapted to lie on the floor and arms connected one to each end of the U-shaped segment and extending upwardly and rearwardly therefrom and on one side thereof, when the bouncer/bassinet is in a deployed configuration;

a connector attached to an upper end of each arm;

first and second U-shaped supports attached to the connectors for carrying a cradle-like bed, said first and second U-shaped supports being pivotally movable with respect to one another between a deployed position wherein they are apart from one another and a collapsed position wherein they are closely adjacent one another, as a continuation of and in substantially a same plane as the arms; and folding mechanisms in the base joining each of the arms to the ends of the U-shaped segment, enabling the arms to pivot on the ends of the U-shaped segment in a forward direction through approximately at least 270° so that the arms and the first and second U-shaped supports lie substantially parallel to and on the other side of the U-shaped segment.

2. The baby support as defined in claim 1 wherein one of the U-shaped supports is fixed with respect to the arms in substantially the same plane as the arms.

3. The baby support as defined in claim 1 wherein a U-shaped canopy frame member is disposed adjacent one of the U-shaped supports and in a stored position lies essentially parallel thereto and in an active position is joined to the connector and diverges from the connector away from that U-shaped support.

4. The baby support as defined in claim 3 wherein the canopy frame is detachably joined to the connector by a post mounted on the connector and a slot receiving the post on each end of the canopy frame.

5. The baby support as defined in claim 1 wherein a vibrator is mounted in one of the folding mechanisms.

6. The baby support as defined in claim 1 wherein each of the connectors includes a pair of substantially parallel sockets that receive the ends of the arms and the ends of one of the U-shaped supports.

7. The baby support as defined in claim 6 wherein the sockets are substantially coaxial.

8. The baby support as defined in claim 6 wherein the ends of the other of the U-shaped supports are pivotally attached to the connectors.

9. The baby support as defined in claim 8 wherein a socket is provided in each of the connectors substantially perpendicular to the other sockets.

10. A baby support comprising:

a base having a U-shaped floor engaging portion and pair of arms that extend upwardly and rearwardly from the U-shaped portion and on one side thereof when in a deployed configuration;

a connector mechanism joining the arms to the ends of the U-shaped portion enabling the arms to pivot on the connector mechanism through an arc of approximately 315° so as to lie substantially in a same plane as the U-shaped portion and on the other side thereof; and a collapsible frame for a baby receptacle attached to the other ends of the arms and when in a collapsed position lying in substantially the same plane as the arms, and carried by the arms above the floor when in the deployed configuration and lying substantially in the plane of the U-shaped portion when in a stored configuration.

11. The baby support as defined in claim 10 wherein a cradle-like baby support is suspended from U-shaped supports of the collapsible frame, said baby support having a foldable bottom wall enabling the baby support to collapse to a flat configuration when the U-shaped supports are in the collapsed position.

12. The baby support as defined in claim 11 wherein a cradle-like baby support is connected to the U-shaped supports, and a pair of canopies are connected to the baby support adjacent the first and second U-shaped supports and movable between elevated and collapsed positions, and a closure mechanism for connecting the canopies together when in the elevated position to enclose a top of the baby support.

13. The baby support as defined in claim 11 wherein a fastener is attached to one end of the baby support for selectively elevating the bottom wall at that end for positioning a baby within the baby support into a substantially sitting position.

14. A baby support comprising:

a base having a portion adapted to lie on the floor and pair of arms that extend from their first ends upwardly and rearwardly from the portion and on one side thereof when in a deployed configuration;

a connector mechanism joining the first ends of the arms to the portion, enabling the arms to pivot through an arc so as to lie substantially in a same plane as the portion and on the other side thereof; and a collapsible frame for a baby receptacle attached to the other ends of the arms and when in a collapsed position lying in substantially the same plane as the arms and carried by the arms above the portion when in the deployed configuration and lying substantially in the plane of the portion when in a stored configuration.

15. The baby support as defined in claim 14 wherein U-shaped supports of the collapsible frame support a baby receptacle, the baby receptacle having a foldable bottom wall enabling the baby receptacle to collapse to a flat configuration when the U-shaped supports are in the collapsed position.

16. The baby support as defined in claim 15 wherein one of the U-shaped supports is fixed with respect to the arms in substantially the same plane as the arms.

17. The baby support as defined in claim 16 wherein a fastener is attached to one end of the baby receptacle for selectively elevating the bottom wall at that end for positioning the baby receptacle into a substantially sitting position.

18. The baby support as defined in claim 16 wherein the said one of the U-shaped supports defines the head end of receptacle and the other U-shaped support defines the foot end of the receptacle and is at an acute angle to the arms, said receptacle having a bottom wall with the height of the side wall increasing from the front end to the head end thereof.

19. The baby support as defined in claim 14 wherein the arms are pivotable through an arc of approximately 315°.

20. A baby support comprising:

a base having a floor engaging portion and pair of arms connected at first ends to and extending upwardly and rearwardly from the portion to one side thereof when in a deployed configuration;

a folding mechanism joining the arms to the ends of the floor engaging portion, enabling the arms to pivot around their first ends on the folding mechanism through an arc of approximately at least 270° so as to lie substantially in a same plane as the floor engaging portion and on the other side thereof; and a collapsible frame for supporting a baby receptacle attached to the other ends of the arms, and when collapsed lying in substantially the same plane as the arms and carried by the arms above the floor when in the deployed configuration and lying substantially in the plane of the floor engaging section when in a stored configuration.

21. The baby support as described in claim 20 wherein the folding mechanism includes a lock for releasably holding the arms in the deployed position.

22. The baby support as described in claim 20 wherein the lock is adapted to hold the arms in the collapsed position on the other side of the floor engaging portion.

23. A baby support comprising:

a base having a portion adapted to lie on the floor and pair of arms that extend from their first ends upwardly and rearwardly from the portion and on one side thereof when in a deployed configuration;

a connector mechanism joining the first ends of the arms to the portion, enabling the arms to pivot rearwardly and downwardly through an arc so as to lie substantially in a same plane as the portion and on the other side thereof; and a collapsible frame for a baby receptacle attached to the other ends of the arms and when in a collapsed position lying in substantially the same plane as the arms and carried by the arms above the portion when in the deployed configuration and lying substantially in the plane of the portion when in a stored configuration.

24. The baby support as defined in claim 23 wherein the arms extend substantially parallel to and in the same direction from the connectors as the portion in a collapsed position.

* * * * *